United States Patent [19]

Tugwood

[11] Patent Number: 4,865,230

[45] Date of Patent: Sep. 12, 1989

[54] FLUID DISPENSER

[75] Inventor: Edward Tugwood, Iver Heath, United Kingdom

[73] Assignee: Schering Corporation, Kenilworth, N.J.

[21] Appl. No.: 108,334

[22] Filed: Oct. 14, 1987

[30] Foreign Application Priority Data

Oct. 14, 1986 [GB] United Kingdom ..... 8624620

[51] Int. Cl.[4] ..... B67D 5/40

[52] U.S. Cl. ..... 222/383; 222/536; 222/538; 222/556

[58] Field of Search ..... 222/379, 383, 321, 389, 222/402.12, 401, 533, 536, 538, 402.11, 525, 523, 567, 545, 530, 475, 566; 239/333, 377, 397, 442; 285/184, 23; 169/51, 74, 75

[56] References Cited

U.S. PATENT DOCUMENTS

| | | | |
|---|---|---|---|
| 1,544,503 | 6/1925 | Thomson | 222/530 X |
| 1,838,468 | 12/1931 | Thomson | 222/475 |
| 2,516,040 | 7/1950 | Zumdahl | 222/525 X |
| 2,536,277 | 1/1951 | Grieme | 222/536 X |
| 2,630,247 | 3/1953 | Rafferty | 222/530 X |
| 2,893,611 | 7/1959 | Akers | 222/536 |
| 3,142,421 | 7/1964 | Sieracki | 222/567 X |
| 3,148,806 | 9/1964 | Meshberg | 222/533 X |
| 3,221,950 | 12/1965 | O'Donnell | 222/402.11 |
| 3,276,641 | 10/1966 | Lehmann | 222/538 X |
| 3,610,480 | 10/1971 | Lipfert et al. . | |
| 3,768,475 | 10/1973 | Osborne | 222/402.11 X |
| 4,125,207 | 11/1978 | Ernst et al. | 222/530 X |
| 4,234,127 | 11/1980 | Tada et al. | 222/533 X |
| 4,318,403 | 3/1982 | Sneider | 222/538 X |
| 4,538,747 | 9/1985 | von Schuckmann | 222/340 X |
| 4,564,130 | 1/1986 | Eulenburg | 222/383 X |
| 4,651,904 | 3/1987 | Schuckmann . | |
| 4,657,161 | 4/1987 | Endo et al. | 222/383 X |

FOREIGN PATENT DOCUMENTS

| | | |
|---|---|---|
| 0144879 | 11/1984 | European Pat. Off. . |
| 0179342 | 10/1985 | European Pat. Off. . |
| 8400140 | 1/1984 | PCT Int'l Appl. . |

*Primary Examiner*—Joseph J. Rolla
*Assistant Examiner*—Gregory L. Huson
*Attorney, Agent, or Firm*—Henry P. Nowak; Gerald S. Rosen

[57] ABSTRACT

A hand-held fluid container and dispenser with a fluid reservoir, an applicator tube with two ends, one of which is unattached (free) and the second end of which is in communication with the reservoir and mounted on the body so as to be movable between a rest position in which the unattached end of the tube is adjacent to the body and a range of dispensing positions in which the unattached end of the tube projects from the body, a button actuated by finger pressure to cause fluid to flow from the reservoir through the applicator tube so it can be dispensed, and a cap which holds the applicator tube in the rest position through engagement with the unattached end thereof, the cap being displaceable relative to the applicator tube to permit movement of the applicator tube to the dispensing positions. Preferably the cap means is displaceable longitudinally of the applicator tube.

1 Claim, 3 Drawing Sheets

FLUID DISPENSER

BACKGROUND

The present invention relates to a hand-held fluid dispenser device and a preferred embodiment of the invention is a dispenser device for applying medicated gels and other appropriate fluids to the mouth.

A variety of dispensers are available which are actuated by finger pressure to dispense small quantities of fluid. There are, for example, dispensers used for dispensing tooth cleaning pastes or gels, disclosed for examples in Nos. WO 84/00140, EP-A-0144879 and EP-A-0179342. These dispensers are not, however, suited for the direct application of substances to the mouth. An oral aerosol dispenser of medicaments is disclosed in U.S. Pat. No. 3,610,480 which incorporates a spray directing nozzle rotatable between dispensing and non-dispensing positions. The nozzle does not, however, permit localized application as desirable, for example, with medicated gels. An aerosol dispenser has been suggested which incorporates an elongate applicator tube which can be pivoted to facilitate localized application. This type of dispenser has the disadvantage that the applicator tube may be accidentally moved to a position in which discharge can occur when it is being carried or stored, for examples in a pocket, a handbag or a drawer. Another disadvantage is that the end of the applicator tube which is to be placed in the mouth is left uncovered while the dispenser is stored or transported.

Although it is not a significant problem with aerosols, the use of an applicator tube with, for example, gels could lead to the problem that material remaining within the tube after a dispensing operation would leak out over a period of time.

It is an object of this invention to provide an improved fluid dispenser device in which the above problems are wholly or in large part overcome.

SUMMARY

Accordingly, the present invention consists in one aspect in a hand-held fluid container and dispenser comprising a body having formed therein a fluid reservoir; an elongate applicator tube with two ends, one of which is unattached (free) and the second end of which is in communication with the reservoir and mounted on the body so as to be movable between a rest position in which the unattached end of the tube is adjacent to the body and a range of dispensing positions in which the unattached end of the tube projects from the body; and pump means which are adapted to be actuated by finger pressure to cause fluid to flow from the reservoir through the applicator tube so it can be dispensed; and a cap means which serves to hold the applicator tube in the rest position through engagement with the unattached end thereof, the cap means being displaceable relative to the applicator tube to permit movement of the applicator tube to the dispensing positions.

Advantageously, the cap means is displaceable longitudinally of the applicator tube.

The cap means may be mounted on the container body of the dispenser device, alternatively, the cap means may be mounted on the applicator tube and adapted to cooperate with a member which is provided on said body.

Advantageously, the cap means comprises a sleeve coaxially mounted on the applicator tube. Such cap means may be moved partially to engage a member mounted on the body of the dispenser to hold the applicator tube in the rest position.

Preferably, there is mounted on the body a means which opposes the unattached end of the applicator tube in its rest position, the cap means serving to hold the applicator tube in the rest position through engagement with both the unattached end of the applicator tube and said means.

According to a further aspect of the present invention, there is provided a hand-held fluid container dispenser device which comprises a body (usually of generally cylindrical shape) having formed therein a fluid reservoir; an elongate applicator tube communicating at one end with the reservoir and mounted on the body to-be movable between a rest position in which the unattached end of the tube lies adjacent the body and a range of dispensing positions in which the unattached end of the tube projects from the body; and pump means actuable by finger pressure to cause fluid to flow from the reservoir through the applicator tube, wherein there is provided a sealing element positioned on the body for sealing engagement with the unattached end of the applicator tube in the rest position thereof, there being further provided means for releasably holding the applicator tube in said rest position.

Advantageously, the means for releasably holding the applicator tube comprises complementary parts formed respectively on the unattached end of the applicator tube and on the body.

In one form of the invention, the pump means comprises an actuating member, there being provided means on the actuating member and on the applicator tube respectively, which inter-engage in the rest position of the applicator tube to prevent actuation of the pump means and disengage when the applicator tube is in a dispensing position.

DRAWINGS

The invention will now be described by way of example with reference to the accompanying drawings in which:

FIG. 1 is a side elevation of a fluid dispenser device according to the invention, FIG. 2 is a front elevation of the dispenser device with the applicator tube locked in the rest position, FIG. 3 is a front elevation of the dispenser device with the applicator tube in a dispensing position, FIG. 4 is a rear elevation of the dispenser device, FIG. 5 is a sectional view along line A—A' in FIG. 2, and FIGS. 6 and 7 are partial sectional views illustrating embodiments of the sealing means of the dispenser tube.

DETAILED DESCRIPTION

Figure 1:
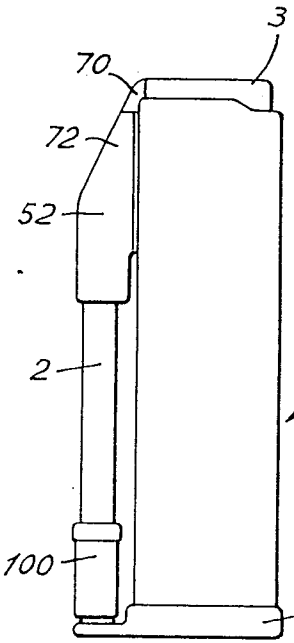
Figure 2:
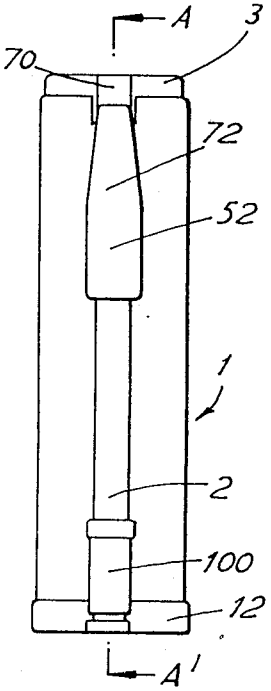
Figure 3:
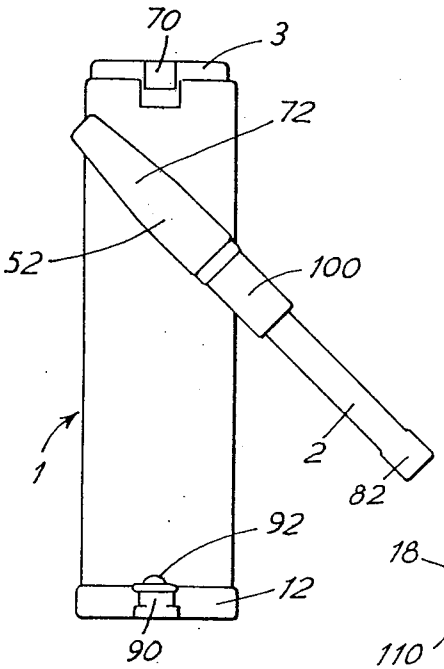

Referring to the drawings, the fluid dispenser device comprises a container body for storing fluid indicated generally by 1, an applicator tube 2 and pump means, activated by a push-button 3, for dispensing the fluid.

Figure 4:
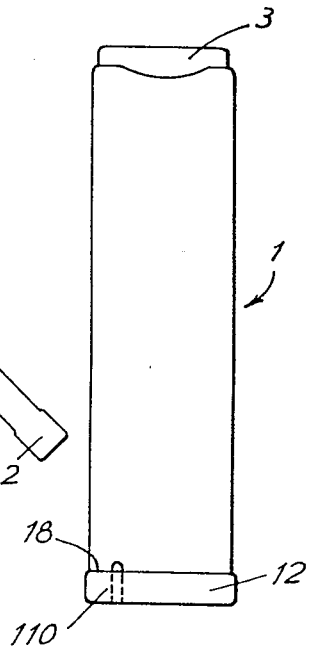
Figure 5:
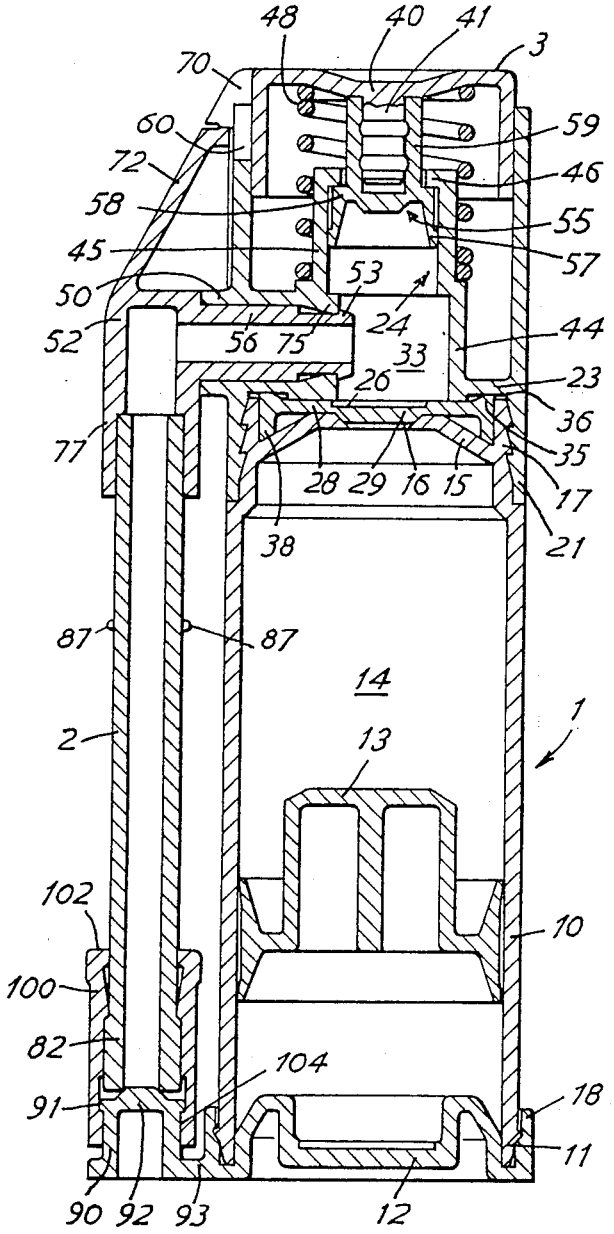

As shown more particularly in FIG. 5, body 1 comprises lower and upper hollow cylinders 10 and 20 respectively. The lower cylinder 10 is open to the bottom but provided with a contoured rim 11 for locking assembly with the bottom cap 12. To ensure correct alignment of the bottom cap 12 with the lower cylinder 10 a small notch 110 (see FIG. 4 )is provided in the bottom rim 11 of the lower cylinder 10 for engagement with an alignment rib (not shown) protruding from the bottom cap 12. The notch 110 extends slightly above the rim 18 of the bottom cap 12 to allow entry of air into the lower cylinder 10 for a purpose more fully described hereinafter. The top end 15 of the lower cylinder 10 is frustoconical in shape with a central circular aperture 16 and a circular rim 17 outwardly contoured for locking assembly with a contoured interior surface 21 of the upper cylinder 20. A freely movable piston 13 is provided within the cylinder 10 and defines the bottom of a fluid reservoir 14. The precise structure of the piston 13 forms no part of this invention and is not described in detail.

The upper cylinder 20 has the same external diameter as the lower cylinder 10. It is connected by a flange 23 to an inner cylinder indicated generally by 24. This inner cylinder 24 is stepped to form cylindrical portions 44 and 45 of different diameters, the portion 45 being narrower than portion 44 and mounted above it. The portions 44 and 45 are connected by a step 47. The function of the inner cylinder 24 will be described later. A non-return valve plate 28 is positioned between the flange 23 and the frustoconical end 15 of the lower cylinder 10. It is held in place by an upwardly projecting rim 35 which is received by an annular recess 36 in the connected flange 23 and by a downwardly projecting rim 38 which abuts the frustoconical end 15. A non-return valve 29 is integrally molded with the valve plate 28 via a radial filament hinge 26.

A push-button actuator 3 is slidably mounted within the upper cylinder 20. It has a concave top 40 from the underside of which there extends a spigot 41. The actuator 3 is also provided with a radially protruding wedge-shaped lug 70 which is slidably received by an open ended slot 60 in the upper cylinder 20. The purpose of the wedge-shaped lug 70 will be described later.

There is provided a top piston indicated generally by 55, which is adapted to slide within upper portion 45 of the inner cylinder 24. It comprises a hollow core 59 connected via a flange 58 to a flexible skirt 57 which grips the inside wall of the cylindrical portion 45. The inner surface of the core 59 is contoured to provide a locking assembly with contours on the spigot 41. A return compression spring 48 rests on the step 47 between the portions 44 and 45. The spring 48 acts on the push-button 3 to return it, and therefore also the top piston 55, to the position shown in the drawings, following depression of the push-button 3. The upper cylindrical portion 45 is provided with an inwardly turned rim 46 to prevent the top piston 55 being forced upwardly out of the inner cylinder 24 by the spring 48. The space defined by the inner cylinder 24, the non-return valve 29 and the top piston 55 provides the upper fluid chamber 33 from which fluid is to be dispensed during operation.

A cylindrical wall 50 extends radially outward from the lower cylindrical portion 44 of the inner cylinder 24 and through the upper cylinder 20 and thus defines a passageway. One arm 56 of a right-angled elbow tube 52 lies within the passageway and is adapted to rotate relative to that passageway, thus forming a swivel joint. The arm 56 has an enlarged rim 53 which abuts the inwardly facing edge 75 of the wall 50. The enlarged rim 53 prevents removal of the arm 56 from the passageway and also helps to ensure that the swivel joint is leakproof. The other arm 77 of the elbow tube 52 is adapted to receive the applicator tube 2. The elbow tube 52 also has an extension 72 which abuts the wedge-shaped lug 70 when the applicator tube 2 is aligned vertically in the rest position, as shown in FIG. 5.

A spigot 90 having a protruding rim 91 is joined to a bottom end cap 12 by a radially extending strip 93. In the rest position shown, the end 82 of the applicator tube 2 is in sealing engagement with the convex upper surface 92 of the spigot 90.

A sleeve 100 is mounted for sliding movement over the length of the applicator tube 2 and over the spigot 90. In the rest position shown, the sleeve 100 is positioned over both the end 82 of the applicator tube 2 and the spigot 90. The sleeve 100 has an inwardly turned rim 104 at its lower end which grips beneath the protruding rim 91 and therefore locks the applicator tube 2 in that position. The interior of the sleeve 100 is also contoured to prevent it slipping off the end 82 of the applicator tube 2 which end has a diameter slightly enlarged relative to the body of the applicator tube 2. The sleeve 100 can be slid up over lugs 87 which project from the tube 2 and held in that position by an inwardly protruding rim 102 on the sleeve 100 which impinges on the projecting lugs 87.

The fluid dispenser reservoir is filled with fluid in the following manner. The bottom cap 12 and the bottom piston 13 are removed, the container body 1 inverted and fluid poured into the fluid reservoir 14. The bottom piston 13 is then reinserted into the reservoir 14 and the air expelled. The push-button 3 is depressed to push-down the piston 55 and the bottom piston 13 is further inserted into the lower cylinder 10. This causes air to be forced from the upper fluid reservoir 33 and replaced with fluid. The bottom cap 12 is then replaced. The conical shape of the top 15 of the cylinder 10 facilitates expulsion of air from the reservoir 14. The shape of the top 15 also reduces frictional resistance to the fluid flow through the aperture 16.

In the case of a viscous fluid, that fluid is retained within the upper reservoir 33 without need for a non-return valve at the entrance to the elbow 52. However, in the case of a non-viscous fluid it may be necessary to include such a valve.

Before the dispenser device can be operated the applicator tube 2 must first be unlocked from the rest position by sliding the sleeve 100 off the spigot 90 and up the tube 2. The sleeve 90 can then be held in position on the tube 2 by its rim 102 which rests on the projecting lugs 87. The tube 2 must then be rotated from the rest position in which its free end is adjacent the body 1 of the dispenser device to a dispensing position in which its unattached end projects away from the body 1 of the dispenser device. The dispenser device cannot be operated when the tube 2 is in the rest position. This is because in the rest position the extension 72 abuts the wedge-shaped lug 70 and prevents depression of the actuator 3 therefore preventing accidental operation of the device. When the tube 2 projects away from the body 1 the extension 72 no longer abuts the wedge-shaped lug 70 which becomes free to slide in the open-ended slot 60.

To operate the fluid dispenser push-button 3 is depressed. This causes the pressure in the chamber 33 to increase. The non-return valve 29 seals firmly and fluid is forced out of the chamber 33 through the applicator tube 2 from which it is dispensed. When the push-button 3 is subsequently released, the pressure in the top cylinder 20 is reduced below atmospheric pressure and the non-return valve 29 opens. Pressure within the container is then equalized as fluid flows from the lower fluid reservoir 14 into the upper fluid reservoir 33 under the action of the bottom piston 13 and air enters the lower cylinder 10 below the bottom piston 13 through the notch 110. The dispenser is thus again ready for use.

It will be recognized that the cap formed by the sliding sleeve 100 holds the applicator tube in the sealed position and therefore prevents leakage of fluid remaining within the applicator tube. It further ensures that the end of the applicator tube that is placed in the mouth is maintained clean. Accidental operation of the dispenser is prevented by the described interlocking engagement between the extension 72 and the wedge-shaped lug 70.

The components of the dispenser device may be formed of injection molded plastics or other suitable materials.

Figure 6:
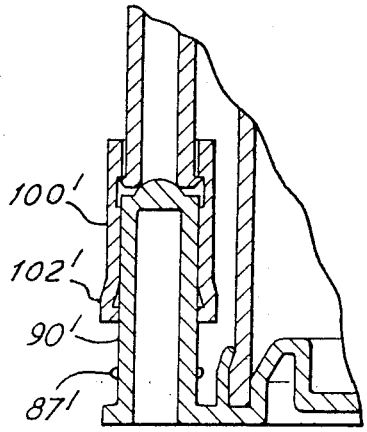

Referring now to FIG. 6, there is illustrated a modification to the above described device. It will be seen that the length of the spigot 90' is increased and the sleeve 100' generally inverted so as to be permanently slidably mounted on the spigot rather than on the tube 2'. The sleeve 100' can be held in a retracted position, in which the tube 2' is free to pivot, by snap engagement between the sleeve in 102' and lugs 87' provided on the spigot 90'.

Figure 7:
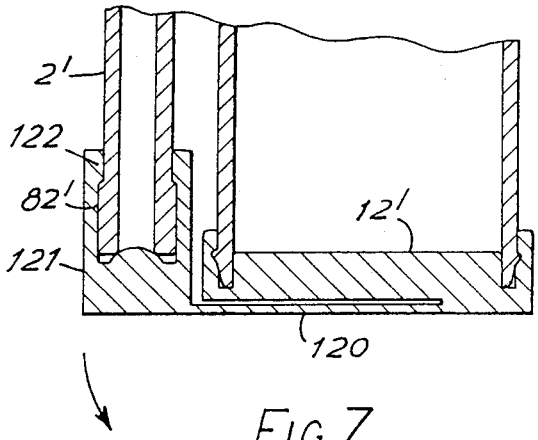

An alternative and more radical modification is illustrated in FIG. 7. The bottom end cap 12' is adapted through a filament hinge 120 to provide a mounting for cap 121. In the rest position shown, cap 121 is held in engagement with the free end 82' of the applicator tube 2' by means of an inwardly directed cap rim 122 engaging behind the enlarged end of the tube. Hinged movement of the cap 121 in the direction of the arrow in FIG. 7 frees the tube for pivoting movement.

The pump means may be of the kind described but may also be provided by other means, for example, an aerosol. This would be actuated by finger pressure on a button or other release member.

The present invention has been described with particular reference to its use as a dispenser for oral use. However, it will be understood that the hand-held dispenser device of the present invention can be used for other purposes where it is desired to apply a fluid to a particular location and also to carry or store the dispenser in, for example, a pocket, handbag or drawer, without fear of accidental operation and spillage.

I claim:

1. A hand held container and fluid dispenser device comprising:

(a) a container body having therein a fluid reservoir:

(b) an elongate fluid applicator tube with two ends, one of which is an unattached end and the second end of which is pivotally disposed on said container body in operative fluid flow connection with said reservoir, wherein said applicator tube is movable between a rest position in which the unattached end is adjacent said body and axially aligned with a cap retaining means, and dispensing position in which the unattached end of said applicator tube projects from said container body:

(c) fluid delivery means disposed in communication between said fluid reservoir and said second end of said applicator tube, said delivery means comprising pump means actuable by finger pressure to cause fluid to flow through the applicator tube: and (d) cap means displaceable longitudinally of said applicator tube and permanently slidably mounted upon said cap retaining means which is permanently mounted on said container body, said cap means being displaceable from a first position which engages said applicator tube when said tube and said retaining means are axially aligned and in which the cap means substantially covers the unattached end of said applicator tube and locks the applicator tube in said rest position by engagement with said cap retaining means, to a second axially displaced position on said cap retaining means in which the cap means uncovers the unattached end of said applicator tube enabling it to move out of axial alignment with said cap retaining means and to said dispensing positions.

* * * * *

UNITED STATES PATENT AND TRADEMARK OFFICE

CERTIFICATE OF CORRECTION

PATENT NO. : 4,865,230
DATED : Sept. 12, 1989
INVENTOR(S) : Edward Tugwood

It is certified that error appears in the above-identified patent and that said Letters Patent is hereby corrected as shown below:

On the cover page, left column:

Change Assignee from "Schering Corporation, Kenilworth, N.J." to---Scholl, Inc., Memphis, Tenn.---

Signed and Sealed this

Eleventh Day of September, 1990

*Attest:*

*Attesting Officer*

HARRY F. MANBECK, JR.

*Commissioner of Patents and Trademarks*